US007799174B2

(12) United States Patent
Bartelmuss et al.

(10) Patent No.: US 7,799,174 B2
(45) Date of Patent: Sep. 21, 2010

(54) FOIL FOR PAPER PRODUCTION SYSTEMS

(76) Inventors: Klaus Bartelmuss, Nr. 63, Teufenbach (AT) A-8833; Heinz Bartelmuss, Nr. 63, Teufenbach (AT) A-8833

( * ) Notice: Subject to any disclaimer, the term of this patent is extended or adjusted under 35 U.S.C. 154(b) by 656 days.

(21) Appl. No.: 11/803,374

(22) Filed: May 14, 2007

(65) Prior Publication Data

US 2008/0017343 A1 Jan. 24, 2008

(30) Foreign Application Priority Data

Jul. 20, 2006 (AT) ..... 1234/2006

(51) Int. Cl.
*D21F 1/52* (2006.01)

(52) U.S. Cl. ..... 162/352; 162/374

(58) Field of Classification Search ..... 162/211, 162/217, 351, 352, 374, 363
See application file for complete search history.

(56) References Cited

U.S. PATENT DOCUMENTS 3,535,204 A * 10/1970 Truxa ..... 162/352
3,928,125 A * 12/1975 Poeschl ..... 162/352
4,184,915 A * 1/1980 Metcalf ..... 162/352
5,630,910 A * 5/1997 McPherson ..... 162/352

* cited by examiner

*Primary Examiner*—Eric Hug
(74) *Attorney, Agent, or Firm*—Laurence A. Greenberg; Werner H. Stemer; Ralph E. Locher

(57) ABSTRACT

A foil for paper production systems has a carrier strip and mutually adjoining plates of ceramic material. The plates are fixed to the carrier strip by way of a plurality of clips, whose free ends are latched to the plates. On their side facing the carrier strip, the plates of a ceramic material are formed with strips projecting from the latter and extending in the longitudinal direction of the carrier strip, which are formed with undercuts along their side edges, the free ends of the clips, which are oriented toward one another, projecting into the lateral undercuts of the strips projecting from the plates.

12 Claims, 3 Drawing Sheets

FOIL FOR PAPER PRODUCTION SYSTEMS

CROSS-REFERENCE TO RELATED APPLICATION

This application claims the priority, under 35 U.S.C. §119, of Austrian patent application A 1234/2006, filed Jul. 20, 2006; the prior application is herewith incorporated by reference in its entirety.

BACKGROUND OF THE INVENTION

Field of the Invention

The present invention relates to a foil for paper production systems. The device includes a carrier strip and mutually adjoining plates of a ceramic material which are fixed to the former. A plurality of clips are disposed in the carrier strip the free ends of which are latched to the plates of the ceramic material.

Since foils for paper production systems are subject to very high wear, it is known to form these as carrier strips, which are produced from metal or from a plastic, these carrier strips being coated with plates of a ceramic material their surface assigned to the wire of a paper production system. Since ceramic materials exhibit very great hardness, in this way the requirement for high abrasion resistance is met.

On account of the great hardness of ceramic materials, however, there is the difficulty that these plates can be produced only with very limited dimensions, for which reason a large number of such plates are needed for the coating of the carrier strips and have to be fixed to the carrier strips so as to lie close beside one another. During this fixing, it is necessary to ensure that the plates lie beside one another at the same height, in order in this way to avoid projecting edges which otherwise occur at their butt joints and by which the wire moved over the plates is damaged.

The shaping of such plates is carried out by these being produced in a pressing operation and in a following sintering operation. In this case, on the side resting on the carrier strips, they can be formed with cutouts and projections, like strips, which are used for their fixing to the carrier strips. Furthermore, when fixing the plates of a ceramic material to carrier strips, it is necessary to take into account that the plates have only a low tensile strength and bending strength and, as a result, exhibit high susceptibility to fracture.

In order to fix plates of a ceramic material to carrier strips, it is known in particular to form the plates with strips projecting from the latter, which project into associated grooves provided in the carrier strips, being cast in the grooves by means of a plastic material. In the case of this type of fixing, however, on account of thermal expansions of the plastic material, the intended flat surface of the mutually adjoining plates is not ensured.

Furthermore, it is known for both the plates of a ceramic material and the carrier strips at the mutually adjoining surfaces to be formed with mutually assigned cutouts, in particular grooves, and to provide connecting elements that are inserted into the cutouts of the plates and the carrier strips and that are fixed in the latter, for example by means of a plastic material. Since these connecting elements extend over the butt joints between the individual plates, the plates located beside one another are kept at the same height, which avoids the formation of projecting edges. However, since in the case of this type of fixing of the plates to the carrier strips the plates are loaded in tension or in flexure by means of the connecting elements projecting into them, the risk of fracture of the plates is increased critically as a result. In this case, it is necessary to take into account that, as a result of the grooves provided in the plates, the thickness of the latter is reduced, as a result of which their resistance to fracture is reduced and, in addition, notch effects are caused by the grooves.

It is also known to form the plates with cutouts located at a distance from one another, into which the free ends of fixing clips anchored in the carrier strips project and are fixed in the latter, likewise by means of a plastic material. However, this type of fixing does not meet the requirements since, as a result of the clips, the butt joints of two mutually adjacent plates are not bridged, which means that likewise projecting edges can be formed and since, in addition, tensile loadings are exerted on the plates as a result, which means that the latter are threatened with fracture. This risk of fracture is increased still further by the fact that the resistance to fracture of the plates is also reduced by the cutouts in the plates.

SUMMARY OF THE INVENTION

The present invention is thus based on the object of providing a foil for a paper production facility which overcomes the disadvantages associated with the prior art devices of this general kind.

With the above and other objects in view there is provided, in accordance with the invention, a foil for a paper production system, comprising:

a carrier strip having a longitudinal direction;

mutually adjoining plates of ceramic material disposed on the carrier strip, the plates having a support surface facing toward the carrier strip, the support surface having strips projecting therefrom, the strips extending in the longitudinal direction and having edges formed with lateral undercuts; and a plurality of clips fixing the plates to the carrier strip, the clips having free ends facing towards one another and projecting into the lateral undercuts of the strips projecting from the plates.

In other words, the objects of the invention are achieved in that, on their side facing the carrier strip, the plates of a ceramic material are formed with strips projecting from the latter and extending in the longitudinal direction of the carrier strip, which are formed with undercuts along their side edges, the free ends of the clips, which are oriented toward one another, projecting into the lateral undercuts of the strips projecting from the plates.

Since in this case the plates of a ceramic material are not formed with cutouts, in particular grooves, their resistance to fracture is not reduced. Since, moreover, the free ends of the clips are oriented toward one another, only compressive forces are exerted on the plates by the latter, which means that there is no risk of fracture for the plates.

Part of the clips preferably extends beyond the end faces of two mutually adjoining plates of a ceramic material, which means that the free ends of a clip in each case project into the undercuts of the strips of two plates located beside each other.

The clips are preferably produced from a resilient material, in particular from sheet steel. In this case, the clips are approximately U shaped in cross section with a central web and with two lateral limbs, the free ends of the lateral limbs being oriented toward each other. Moreover, the central web of the clips is preferably formed with at least one outwardly angled portion oriented away from the lateral limbs. In addition, at least one of the two lateral limbs of the clips can be formed with a slot oriented transversely with respect to the longitudinal direction of the carrier strip.

According to a preferred embodiment, on its surface facing the plates of a ceramic material, the carrier strip is formed with a groove oriented in its longitudinal extent, wherein groove the clips are located and into which the undercut strips projecting from the plates project. According to an alternative embodiment, the foil is produced in that a carrier strip is produced in a casting operation and, in the process, is connected to the plates of a ceramic material and to the clips latched to the latter.

Other features which are considered as characteristic for the invention are set forth in the appended claims.

Although the invention is illustrated and described herein as embodied in foil for paper production system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
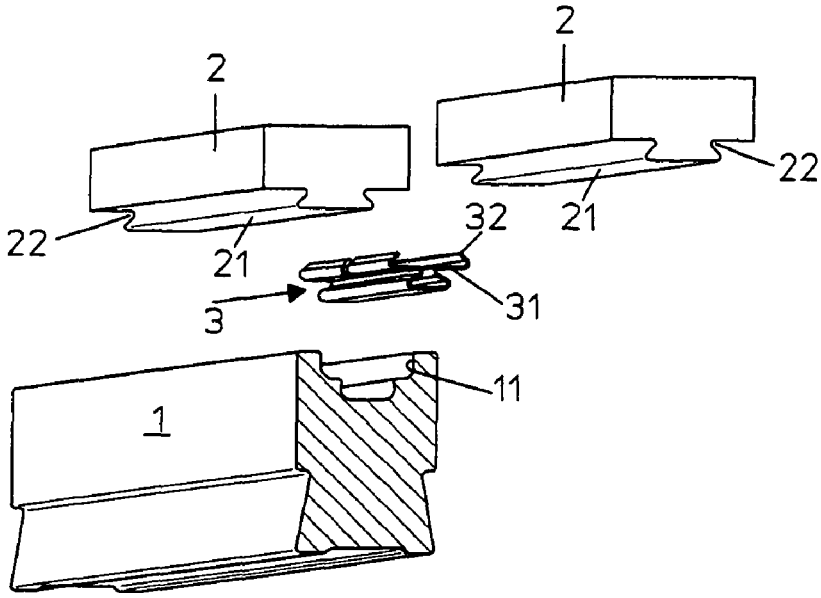
FIG. 1 is an exploded, perspective view of a portion of a foil according to the invention.
Figure 1A:
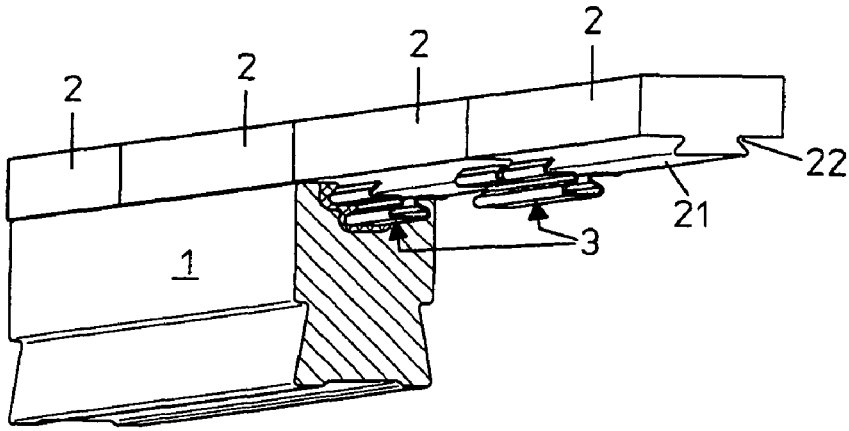
FIG. 1A is a perspective view of the foil according to FIG. 1.

Referring now to the figures of the drawing in detail and first, particularly, to FIGS. 1 and 1A thereof, the foil according to the invention comprises a carrier strip 1, plates 2 of a ceramic material fixed to the latter, and clips 3. The clips 3 affix the plates 2 to the carrier strip 1.

The carrier strip 1, which is produced from metal, in particular from stainless steel, or from a plastic material, in particular from glass fiber reinforced plastic, is formed with a groove 11 extending in its longitudinal direction on its side facing the plates 2. On their side facing away from the upper side, along which the wire of a paper production system is moved, the plates 2 of a ceramic material are formed with a strip 21 that projects and extends in the longitudinal direction of the carrier strip 1 and which, along its lateral edges, is formed with undercuts 22. The side of the plates facing the carrier strip 1 will be referred to as the support surface. The clips 3, which are preferably produced from stainless steel sheet, are approximately U shaped, having a central web 31 and two lateral limbs 32 oriented toward each other. The clips 3 can be deformed elastically. The dimensions of the strips 21 and of the clips 3 are chosen such that they can be inserted into the groove 11 located in the carrier strip 1.

A variety of exemplary embodiments of the clips 3 are explained below with reference to FIGS. 4, 4A, 4B, and 4C.

In order to produce a foil, the clips 3 are placed on the plates 2 of a ceramic material in such a way that the free ends of the limbs 32 project into the undercuts 22 of the strips 21. Furthermore, the clips 3 are arranged with respect to the plates 2 in such a way that they extend over the butt joints of two mutually adjacent plates 2. Then, the plates 2 formed with the clips 3 are inserted with their strips 21 into the groove 11 of the carrier strip 1, and are cast in the latter by means of a plastic material.

Since the plates 2 of a ceramic material are formed only with strips 21 projecting from these, onto which the resilient clips 3 are placed, only compressive forces are exerted on the plates 2. Since, moreover, the clips 3 are placed onto the strips 21 of two plates 2 lying beside each other in such a way that they extend over the butt joints, height adjustments between plates 2 located beside one another are avoided and no projecting edges can form at the butt joints.

Figure 2:
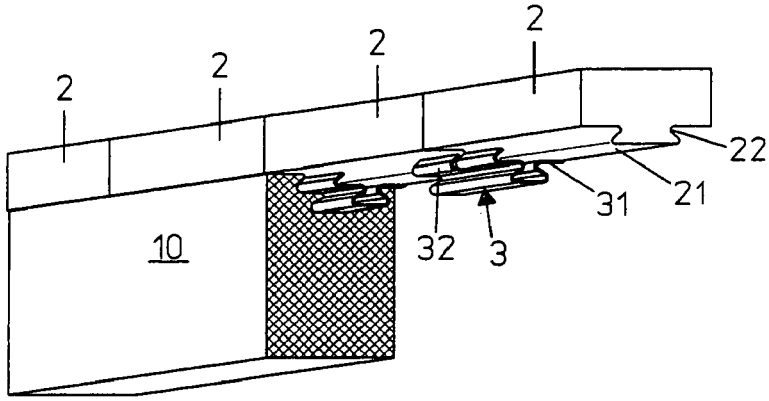
FIG. 2 is a perspective view of a second embodiment of the foil according to the invention.

The embodiment according to FIG. 2 differs from the embodiment according to FIG. 1A in that the carrier strip 10, which is composed of a plastic material, in particular of a glass fiber reinforced plastic, is produced and connected to the plates 2 of a ceramic material and to the clips 3 in that they are fitted to the plates 2 having the strips 21 and the clips 3 latched to the latter in a casting operation.

Figure 3:
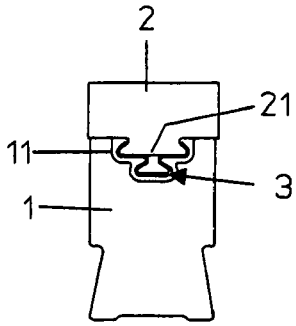
FIGS. 3, 3A, 3B are end views of three embodiments of foils according to the invention.

A number of embodiments of a foil according to the invention are illustrated in FIGS. 3, 3A, 3B and 3C:

The embodiment of FIG. 3 is that which has been explained by using FIG. 1.

Figure 3A:
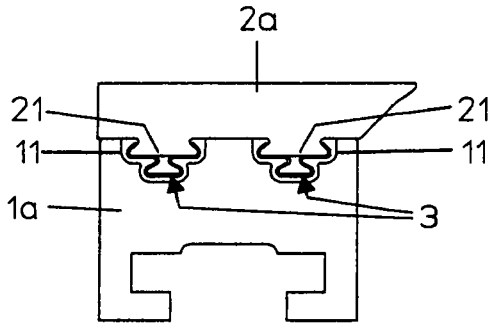

The embodiment according to FIG. 3A differs from the embodiment according to FIG. 3 in that the carrier strip 1*a*, which is substantially wider, is formed with two grooves 11, and in that the plates 2*a* of a ceramic material, which are wider, are formed with two strips 21, onto which the clips 3 are placed, the strips 21 and the clips 3 being cast in the grooves 11 by means of a plastic material.

Figure 3B:
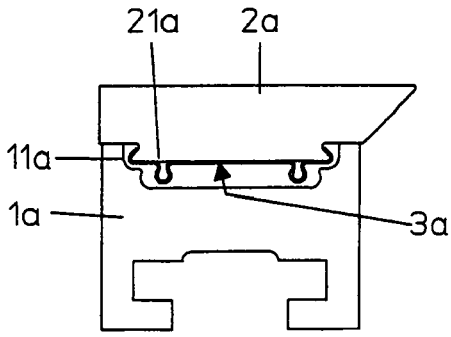

The embodiment according to FIG. 3B differs from the embodiment according to FIG. 3 in that the carrier strip 1*a* is formed with a substantially wider groove 11*a*, and in that the plates 2*a* of a ceramic material are formed with substantially wider strips 21*a*, to which correspondingly wider clips 3*a* are assigned. The carrier strips 1 and 1*a* are formed with profiling extending longitudinally, such as a groove, by means of which they can be detachably fixed to a stationary carrier belonging to the system.

Figure 4:
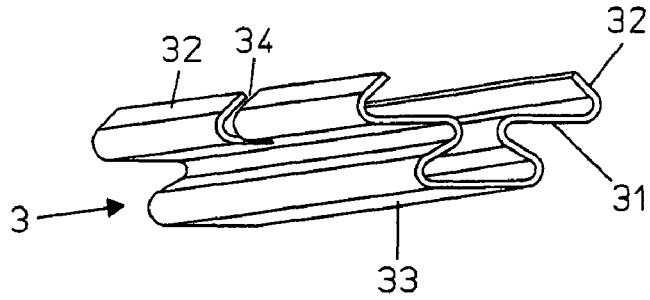
FIGS. 4, 4A, 4B, 4C are perspective views of four clips according to the invention.

FIG. 4 illustrates a first embodiment of a clip 3 which is formed with a central web 31 and two lateral limbs 32, the free ends of the two limbs 32 being oriented toward each other. In addition, the central web 31 is formed with an outwardly angled portion 33 oriented away from the limbs 32. In addition, at least one of the two limbs 32 is formed with a slot 34 in its central region. As a result of forming the clips 3 with at least one outwardly angled portion 33 and with slots 34, their elasticity is increased.

Figure 4A:
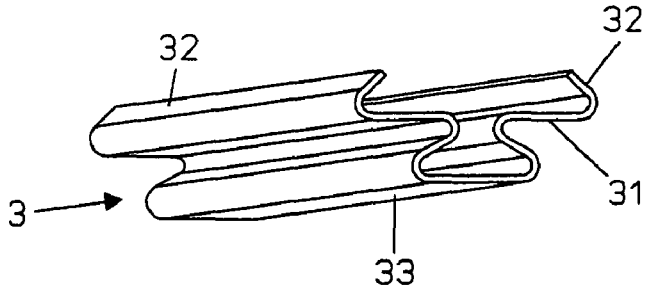

The clip 3 according to FIG. 4A is formed without a slot.

Figure 4B:
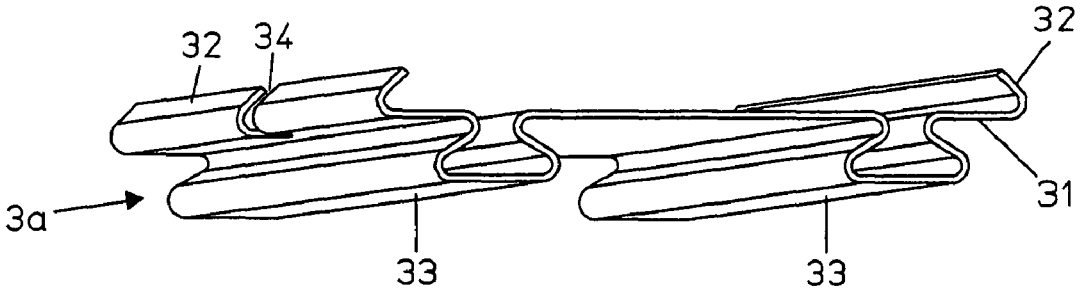

The clip 3*a* according to FIG. 4B is approximately twice as wide as the clip 3 according to FIG. 4, its central web 31 being formed with two outwardly angled portions 33 which are oval in cross section.

Figure 4C:
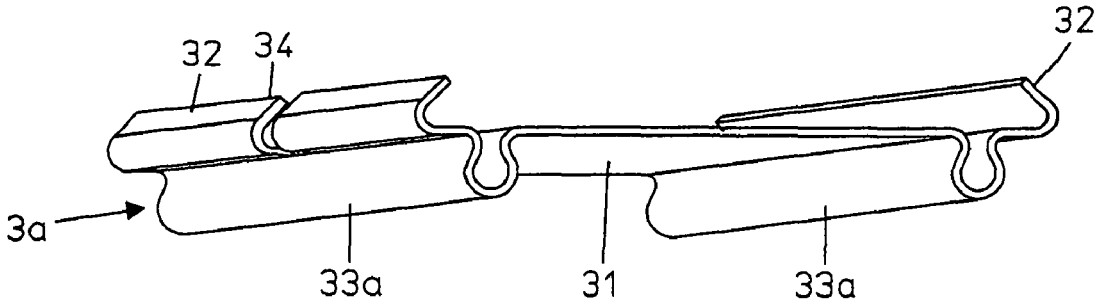

The clip 3*a* according to FIG. 4C differs from the clip 3 according to FIG. 4B in that the outwardly angled portions 33*a* are approximately circular in cross section.

We claim:

1. A foil for a paper production system, comprising:

a carrier strip having a longitudinal direction;

mutually adjoining plates of ceramic material disposed on said carrier strip, said plates having a support surface facing toward said carrier strip, said support surface having strips projecting therefrom, said strips extending in said longitudinal direction and having edges formed with lateral undercuts; and a plurality of clips fixing said plates to said carrier strip, said clips having free ends facing towards one another and projecting into said lateral undercuts of said strips projecting from said plates; and at least part of said clips extending beyond end faces of two mutually adjoining plates of ceramic material, such that said free ends of a given clip project into said undercuts of said strips of two mutually adjoining plates.

2. The foil according to claim 1, wherein said clips are formed of a resilient material.

3. The foil according to claim 2, wherein said clips are formed of sheet steel.

4. The foil according to claim 1, wherein said clips are approximately U-shaped in cross section, with a central web and two lateral limbs, said lateral limbs having said free ends oriented towards each other.

5. The foil according to claim 4, wherein said central web of the clips is formed with at least one outwardly angled portion oriented away from said lateral limbs.

6. The foil according to claim 4, wherein at least one of said two lateral limbs of said clips is formed with a slot oriented transversely with respect to said longitudinal direction of said carrier strip.

7. The foil according to claim 1, wherein said carrier strip has a side facing said plates of ceramic material, said side has a groove formed therein oriented in the longitudinal direction, and wherein said clips are disposed in said groove and said strips project from said plates into said groove.

8. The foil according to claim 1, wherein said carrier strip is a cast material strip, and said plates of ceramic material with said clips mounted thereto are subsequently latched to said strip.

9. A method of producing a foil according to claim 1, which comprises casting a carrier strip in a casting operation, providing plates of ceramic material with clips latched thereto, and latching the clips to said carrier strip for mounting said plates to said carrier strip and for forming the foil according to claim 1.

10. A foil for a paper production system, comprising:

a carrier strip having a longitudinal direction;

mutually adjoining plates of ceramic material disposed on said carrier strip, said plates having a support surface facing toward said carrier strip, said support surface having strips projecting therefrom, said strips extending in said longitudinal direction and having edges formed with lateral undercuts; and a plurality of clips fixing said plates to said carrier strip, said clips having free ends facing towards one another and projecting into said lateral undercuts of said strips projecting from said plates;

wherein said clips are approximately U-shaped in cross section, with a central web and two lateral limbs, said lateral limbs having said free ends oriented towards each other; and wherein said central web of the clips is formed with at least one outwardly angled portion oriented away from said lateral limbs.

11. A foil for a paper production system, comprising:

a carrier strip having a longitudinal direction;

mutually adjoining plates of ceramic material disposed on said carrier strip, said plates having a support surface facing toward said carrier strip, said support surface having strips projecting therefrom, said strips extending in said longitudinal direction and having edges formed with lateral undercuts; and a plurality of clips fixing said plates to said carrier strip, said clips having free ends facing towards one another and projecting into said lateral undercuts of said strips projecting from said plates;

wherein said clips are approximately U-shaped in cross section, with a central web and two lateral limbs, said lateral limbs having said free ends oriented towards each other; and wherein at least one of said two lateral limbs of said clips is formed with a slot oriented transversely with respect to said longitudinal direction of said carrier strip.

12. A foil for a paper production system, comprising:

a carrier strip having a longitudinal direction;

mutually adjoining plates of ceramic material disposed on said carrier strip, said plates having a support surface facing toward said carrier strip, said support surface having strips projecting therefrom, said strips extending in said longitudinal direction and having edges formed with lateral undercuts; and a plurality of clips fixing said plates to said carrier strip, said clips having free ends facing towards one another and projecting into said lateral undercuts of said strips projecting from said plates;

wherein said carrier strip is a cast material strip, and said plates of ceramic material with said clips mounted thereto are subsequently latched to said strip.

* * * * *